US012000118B2

(12) United States Patent
Shimizu et al.

(10) Patent No.: US 12,000,118 B2
(45) Date of Patent: Jun. 4, 2024

(54) CONSTRUCTION MACHINE

(71) Applicant: Hitachi Construction Machinery Co., Ltd., Tokyo (JP)

(72) Inventors: Juri Shimizu, Tokyo (JP); Kenji Hiraku, Tsuchiura (JP); Hiromasa Takahashi, Tsuchiura (JP); Teppei Saitoh, Tokyo (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 292 days.

(21) Appl. No.: 17/765,570

(22) PCT Filed: Sep. 30, 2020

(86) PCT No.: PCT/JP2020/037212

§ 371 (c)(1),
(2) Date: Mar. 31, 2022

(87) PCT Pub. No.: WO2021/066029

PCT Pub. Date: Apr. 8, 2021

(65) Prior Publication Data

US 2022/0364337 A1 Nov. 17, 2022

(30) Foreign Application Priority Data

Oct. 3, 2019 (JP) ..... 2019-183201

(51) Int. Cl.
*E02F 9/26* (2006.01)
*E02F 3/42* (2006.01)
(Continued)

(52) U.S. Cl.
CPC ..... *E02F 9/265* (2013.01); *E02F 3/425* (2013.01); *E02F 3/437* (2013.01); *E02F 9/2228* (2013.01);
(Continued)

(58) Field of Classification Search
CPC . E02F 9/265; E02F 3/425; E02F 3/437; E02F 9/2228; E02F 9/2267; E02F 9/2289; E02F 9/2292; E02F 9/2296
See application file for complete search history.

(56) References Cited

U.S. PATENT DOCUMENTS 5,356,259 A * 10/1994 Hanamoto ..... E02F 3/438 37/348
6,561,751 B1 5/2003 Ishizaki et al.
(Continued)

FOREIGN PATENT DOCUMENTS

JP 50-26865 Y1 8/1975
JP 56-81741 A 7/1981
(Continued)

OTHER PUBLICATIONS

International Search Report (PCT/ISA/210) issued in PCT Application No. PCT/JP2020/037212 dated Dec. 15, 2020 with English translation (five (5) pages).
(Continued)

*Primary Examiner* — Hunter B Lonsberry
*Assistant Examiner* — Harrison Heflin
(74) *Attorney, Agent, or Firm* — Crowell & Moring LLP

(57) ABSTRACT

A construction machine makes it possible for an operator to linearly push a bucket by operating an arm in a pushing direction. A controller is configured to, in case a straight locus is selected by a bucket locus selecting device, calculate a constant flow rate ratio according to a boom initial angle that is an angle of a boom sensed by a boom angle sensor at a time point when an arm is operated in a pushing direction by an operation device, and control the delivery flow rate of a first hydraulic pump such that a hydraulic fluid is discharged from a boom cylinder cap chamber at a flow rate obtained by multiplying a flow rate of a flow supplied to an arm cylinder cap chamber by the flow rate ratio while the
(Continued)

arm is operated in the pushing direction and there is no boom operating instruction.

4 Claims, 12 Drawing Sheets

(51) Int. Cl.
*E02F 3/43* (2006.01)
*E02F 9/22* (2006.01)

(52) U.S. Cl.
CPC ..... *E02F 9/2267* (2013.01); *E02F 9/2289* (2013.01); *E02F 9/2292* (2013.01); *E02F 9/2296* (2013.01)

(56) References Cited

U.S. PATENT DOCUMENTS

| | | | | |
|---|---|---|---|---|
| 10,794,046 | B2 * | 10/2020 | Imura | E02F 9/26 |
| 2018/0202126 | A1 | 7/2018 | Yunfeng et al. | |
| 2021/0095437 | A1 * | 4/2021 | Brabec | E02F 3/651 |

FOREIGN PATENT DOCUMENTS

| | | | |
|---|---|---|---|
| JP | 2001-90703 | A | 4/2001 |
| JP | 2010-59738 | A | 3/2010 |
| JP | 2016-145603 | A | 8/2016 |
| WO | WO 2020/179204 | A1 | 9/2020 |

OTHER PUBLICATIONS

Japanese-language Written Opinion (PCT/ISA/237) issued in PCT Application No. PCT/JP2020/037212 dated Dec. 15, 2020 (three (3) pages).

International Preliminary Report on Patentability (PCT/IB/338 & PCT/IB/373) issued in PCT Application No. PCT/JP2020/037212 dated Apr. 14, 2022, including English translation of document C2 (Japanese-language Written Opinion (PCT/ISA/237) filed on Mar. 31, 2022) (five (5) pages).

Extended European Search Report issued in European Application No. 20870901.4 dated Jul. 26, 2023 (6 pages).

* cited by examiner

CONSTRUCTION MACHINE

TECHNICAL FIELD

The present invention relates to a construction machine including a hydraulic drive system that directly drives hydraulic actuators by using hydraulic pumps.

BACKGROUND ART

In recent years, in construction machines such as hydraulic excavators, there have been developments underway in hydraulic circuits (defined as closed circuits) in which connection is established such that a hydraulic working fluid is fed from hydraulic driving sources such as hydraulic pumps to hydraulic actuators such as hydraulic cylinders, and the hydraulic working fluid used for performing work at the hydraulic actuators is returned not to a tank, but to the hydraulic pumps, in order to reduce restrictor elements in the hydraulic circuits that drive the hydraulic actuators and to reduce the fuel consumption rate.

Patent Document 1 describes configuration in which, for a backhoe excavator, actuators and pumps are connected to each other in a closed circuit manner.

PRIOR ART DOCUMENT

Patent Document

Patent Document 1: JP-2016-145603-A

SUMMARY OF THE INVENTION

Problem to be Solved by the Invention

Application of the system of Patent Document 1 not to a backhoe excavator, but to a loading excavator, for example, is considered. A loading excavator is an excavator having a structure to push a bucket by extending an arm cylinder. The loading excavator performs horizontal pushing operation of the bucket when performing excavation operation. If the system of Patent Document 1 is applied, it is necessary to finely adjust lever input in the arm cylinder extension direction and lever input in the boom cylinder retraction direction in order to realize the horizontal pushing operation of the bucket. Accordingly, an operator is required to perform complicated input, and this undesirably increases the burden on the operator when she/he performs excavation operation repeatedly.

The present invention has been made in view of the problems described above, and an object of the present invention is to provide a construction machine that allows an operator to linearly push a bucket simply by operating an arm in a pushing direction.

Means for Solving the Problem

In order to achieve the object described above, according to the present invention, in a construction machine including: a boom; an arm pivotably attached to the boom; a bucket pivotably attached to the arm; a boom cylinder that drives the boom in a raising direction by extending operation, and drives the boom in a lowering direction by retracting operation; an arm cylinder that drives the arm in a pushing direction by extending operation, and drives the arm in a crowding direction by retracting operation; an operation device that operates the boom and the arm; a bidirectionally tiltable first hydraulic pump that can be connected to the boom cylinder to form a closed circuit; a bidirectionally tiltable second hydraulic pump that can be connected to the arm cylinder to form a closed circuit; and a controller that, according to operation of the operation device, controls a flow rate of a hydraulic fluid supplied from the first hydraulic pump to the boom cylinder, and a flow rate of the hydraulic fluid supplied from the second hydraulic pump to the arm cylinder, the construction machine includes: a boom angle sensor that senses an angle of the boom; and a bucket locus selecting device that selects either one of an arc locus and a straight locus as a movement locus of the bucket, the movement locus being according to operation of the arm in the pushing direction, and the controller is configured to, in a case where the straight locus is selected by the bucket locus selecting device, calculate a constant flow rate ratio according to a boom initial angle that is the angle of the boom sensed by the boom angle sensor at a time point when the arm is operated in the pushing direction by the operation device, and control a delivery flow rate of the first hydraulic pump such that the hydraulic fluid is discharged from a cap chamber of the boom cylinder at a flow rate obtained by multiplying a rate of a flow supplied to a cap chamber of the arm cylinder by the flow rate ratio while the arm is operated in the pushing direction by the operation device and there is not an instruction for operation of the boom; and control a delivery flow rate of the second hydraulic pump such that the hydraulic fluid is absorbed from the cap chamber of the arm cylinder by the second hydraulic pump at a flow rate according to input of the operation device independently of a selection state of the bucket locus selecting device while the arm is operated in the crowding direction by the operation device.

According to the thus configured present invention, when a straight locus is selected via the bucket locus selecting device and an instruction for pushing operation of the arm is given via the operation device, the constant flow rate ratio is calculated on the basis of the boom initial angle, and while an instruction for pushing operation of the arm is given via the operation device and an instruction for operation of the boom is not given, the delivery flow rate of the first hydraulic pump is controlled such that the hydraulic fluid is discharged from the cap chamber of the boom cylinder at a flow rate obtained by multiplying the flow rate of the flow supplied to the cap chamber of the arm cylinder by the flow rate ratio. Thereby, it becomes possible for an operator to linearly push the bucket simply by operating the arm in the pushing direction.

Advantages of the Invention

The construction machine according to the present invention makes it possible, for an operator, to linearly push a bucket simply by operating an arm in a pushing direction, and thus it becomes possible to mitigate the burden on the operator at time of excavation work.

MODES FOR CARRYING OUT THE INVENTION

Figure 1:
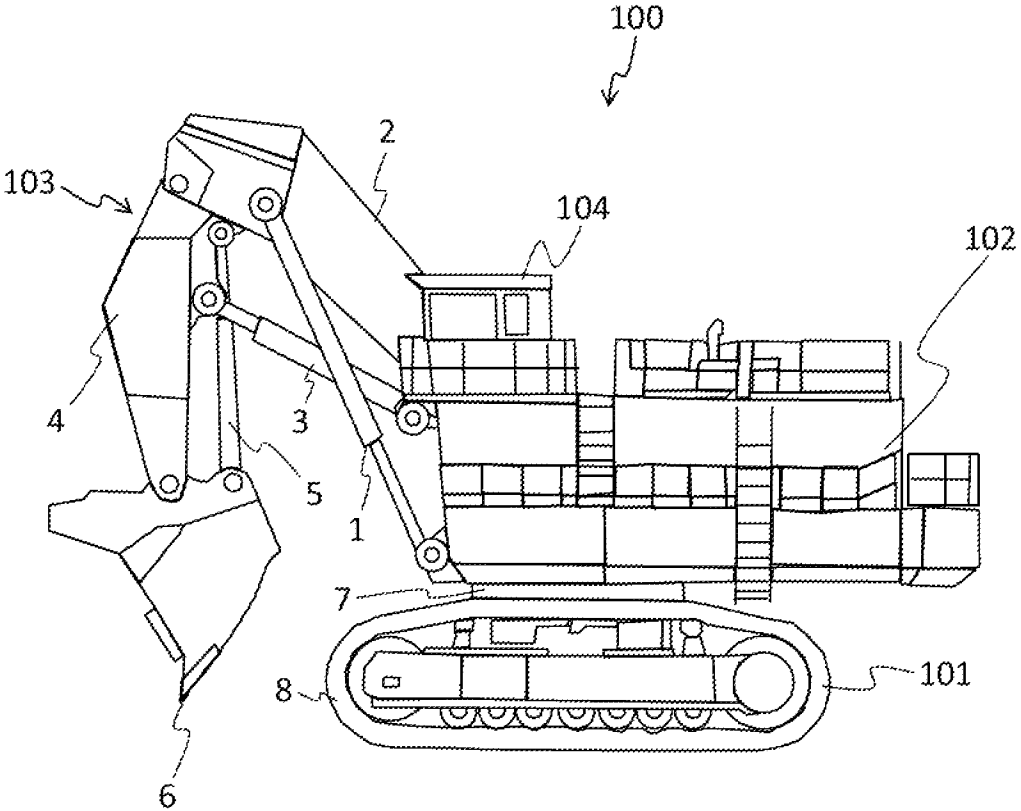
FIG. 1 is a side view of a hydraulic excavator according to a first embodiment of the present invention.

As an example of a construction machine according to embodiments of the present invention, a hydraulic excavator is explained below with reference to the figures. Note that in the figures, equivalent members are given identical reference characters, and overlapping explanations are omitted as appropriate.

First Embodiment

FIG. 1 is a side view of a hydraulic excavator according to a first embodiment of the present invention.

In FIG. 1, a hydraulic excavator 100 includes: a lower travel structure 101 equipped with a crawler type travel device 8; an upper swing structure 102 swingably attached onto the lower travel structure 101 via a swing device 7; and a front work implement 103 attached to a front section of the upper swing structure 102 so as to be pivotable upward/downward. A cab 104 which an operator gets on is provided on the upper swing structure 102. A lever 51 (depicted in FIG. 3) mentioned later is disposed in the cab 104.

The front work implement 103 includes: a boom 2 attached to the front section of the upper swing structure 102 so as to be pivotable upward/downward; an arm 4 coupled to a tip section of the boom 2 so as to be pivotable upward/downward or forward/backward; a bucket 6 coupled at a tip section of the arm 4 so as to be pivotable upward/downward or forward/backward; a boom cylinder 1 that drives the boom 2; an arm cylinder 3 that drives the arm 4; and a bucket cylinder 5 that drives the bucket 6.

Figure 2:
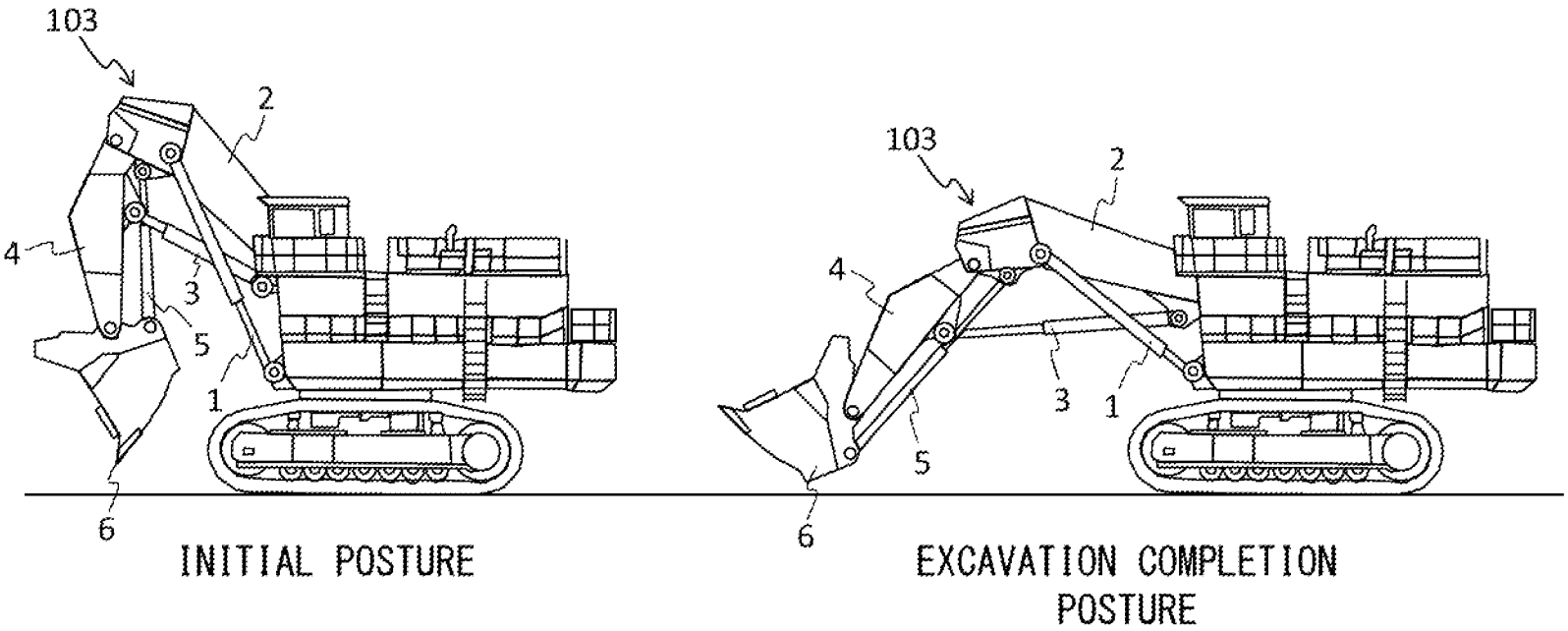
FIG. 2 is a figure depicting operation of the hydraulic excavator depicted in FIG. 1 at time of excavation.

The hydraulic excavator 100 according to the present embodiment is a loading excavator, and is configured to push the bucket 6 forward by extending the arm cylinder 3 or the bucket cylinder 5. As depicted in FIG. 2, the hydraulic excavator 100 at time of excavation repeatedly performs operation of making the transition from a posture (initial posture) at which the arm 4 is crowded and the boom 2 is raised to a posture (excavation completion posture) at which the arm 4 is pushed and the boom 2 is lowered.

Figure 3:
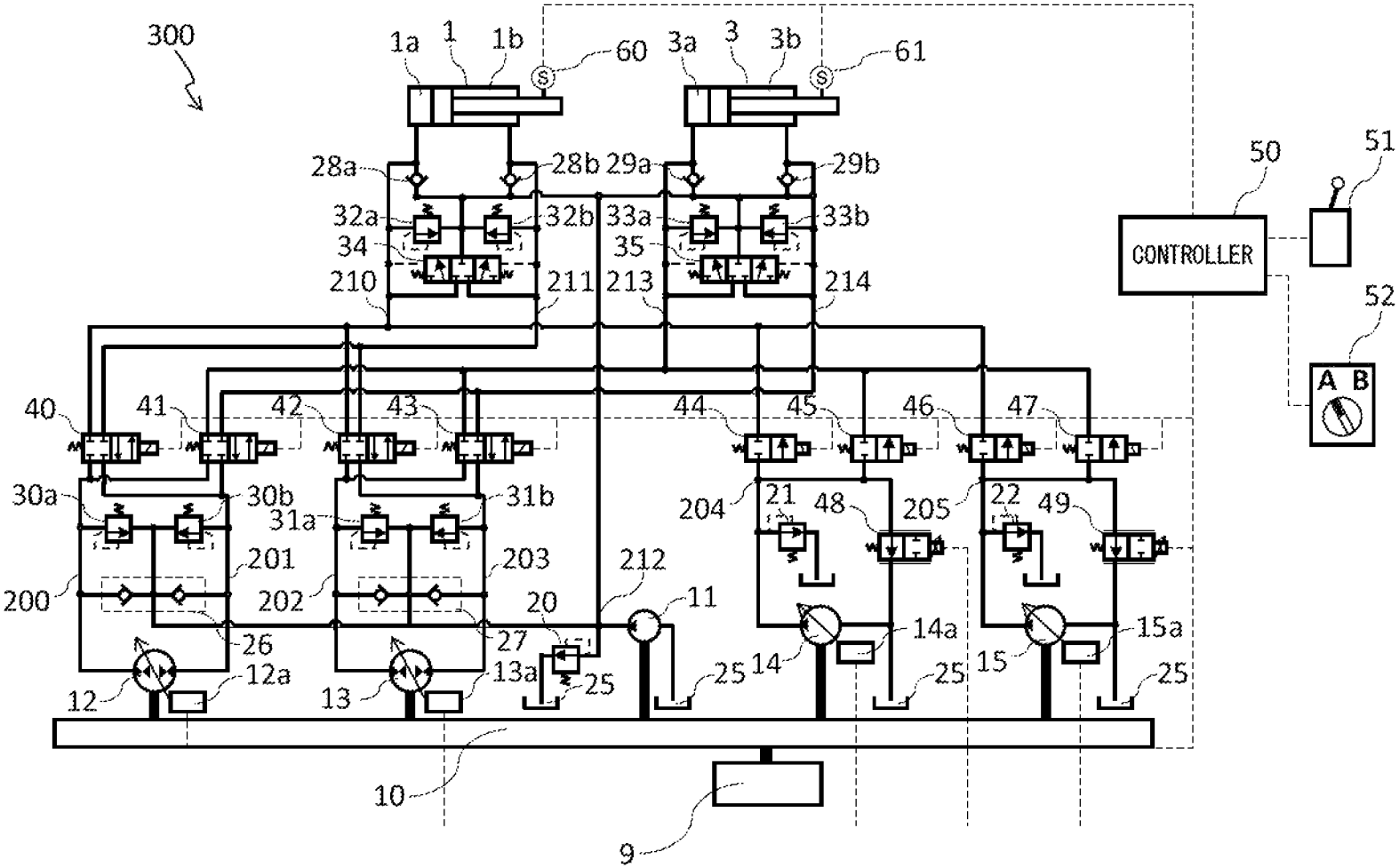
FIG. 3 is a schematic configuration diagram of a hydraulic drive system mounted on the hydraulic excavator depicted in FIG. 1.

FIG. 3 is a schematic configuration diagram of a hydraulic drive system mounted on the hydraulic excavator 100. Note that, for simplification of explanations, FIG. 3 depicts only portions related to driving of the boom cylinder 1 and the arm cylinder 3, and portions related to driving of other actuators are omitted.

In FIG. 3, a hydraulic drive system 300 includes: the boom cylinder 1; the arm cylinder 3; the lever 51 as an operation device that gives instructions for the operation direction and demanded speed of each the boom cylinder 1 and the arm cylinder 3; an engine 9, which is a motive power source; a power transmission device 10 that allocates the motive power of the engine 9; hydraulic pumps 12 to 15 and a charge pump 11 that are driven by the motive power allocated by the power transmission device 10; selector valves 40 to 47 that can switch connection between the hydraulic pumps 12 to 15 and the hydraulic actuators 1 and 3; proportional valves 48 and 49; and a controller 50 that controls the selector valves 40 to 47, the proportional valves 48 and 49, and regulators 12*a*, 13*a*, 14*a*, and 15*a* mentioned later.

The engine 9, which is the motive power source, is connected to the power transmission device 10 that allocates the motive power. The power transmission device 10 is connected with the hydraulic pumps 12 to 15 and the charge pump 11.

The hydraulic pumps 12 and 13 include: bidirectionally tiltable swash plate mechanism having a pair of input/output ports; and regulators 12*a* and 13*a* that adjust the inclination angles of the swash plates. The hydraulic pumps 14 and 15 include: unidirectionally tiltable swash plate functionality having an input port and an output port; and the regulators 14*a* and 15*a* that adjust the tilting angles of the swash plates. The regulators 12*a*, 13*a*, 14*a*, and 15*a* adjust the tilting angles of the swash plates of the hydraulic pumps 12 to 15 according to signals from the controller 50.

The hydraulic pumps 12 and 13 can control the delivery flow rates and directions of a hydraulic working fluid from the input/output ports by adjusting the tilting angles of the swash plates. In addition, the hydraulic pumps 12 and 13 function also as hydraulic motors upon being supplied with a hydraulic fluid.

The pair of input/output ports of the hydraulic pump 12 is connected with flow paths 200 and 201, and the flow paths 200 and 201 are connected with the selector valves 40 and 41. The selector valves 40 and 41 switch the states of the flow paths between the communicating states and the interrupting states according to signals from the controller 50. When there are no signals from the controller 50, the selector valves 40 and 41 are at the interrupting states.

The selector valve 40 is connected to the boom cylinder 1 via flow paths 210 and 211. When the selector valve 40 enters the communicating state according to a signal from the controller 50, the hydraulic pump 12 is connected with the boom cylinder 1 via the flow paths 200 and 201, the selector valve 40, and the flow paths 210 and 211 to thereby form a closed circuit.

The selector valve 41 is connected to the arm cylinder 3 via flow paths 213 and 214. When the selector valve 41 enters the communicating state according to a signal from the controller 50, the hydraulic pump 12 is connected with the arm cylinder 3 via the flow paths 200 and 201, the selector valve 41, and the flow paths 213 and 214 to thereby form a closed circuit.

The pair of input/output ports of the hydraulic pump 13 is connected with flow paths 202 and 203, and the flow paths 202 and 203 are connected with the selector valves 42 and 43. The selector valves 42 and 43 switch the states of the flow paths between the communicating states and the interrupting states according to signals from the controller 50. The selector valves 42 and 43 are at the interrupting states when there are no signals from the controller 50.

The selector valve 42 is connected to the boom cylinder 1 via the flow paths 210 and 211. When the selector valve 42 enters the communicating state according to a signal from the controller 50, the hydraulic pump 13 is connected with the boom cylinder 1 via the flow paths 202 and 203, the selector valve 42, and the flow paths 210 and 211 to thereby form a closed circuit.

The selector valve 43 is connected to the arm cylinder 3 via the flow paths 213 and 214. When the selector valve 43 enters the communicating state according to a signal from the controller 50, the hydraulic pump 13 is connected with the arm cylinder 3 via the flow paths 202 and 203, the selector valve 43, and the flow paths 213 and 214 to thereby form a closed circuit.

The output port of the hydraulic pump 14 is connected to the selector valves 44 and 45, the proportional valve 48, and a relief valve 21 via a flow path 204. The input port of the hydraulic pump 14 is connected to a tank 25.

The relief valve 21 releases the hydraulic working fluid to the tank 25 and protects the circuit when the flow path pressure has become a predetermined pressure or higher.

The selector valves 44 and 45 switch the states of the flow paths between the communicating states and the interrupting states according to signals from the controller 50. When there are no signals from the controller 50, the selector valves 44 and 45 are at the interrupting states.

The selector valve 44 is connected to a cap chamber 1*a* of the boom cylinder 1 via the flow path 210.

The selector valve 45 is connected to a cap chamber 3*a* of the arm cylinder 3 via the flow path 213.

The proportional valve 48 changes its opening area and controls the passing flow rate according to a signal from the controller 50. When there are no signals from the controller 50, the opening area of the proportional valve 48 is kept at the maximum opening area. In addition, when the selector valves 44 and 45 are at the interrupting states, the controller 50 gives a signal to the proportional valve 48 such that the opening area of the proportional valve 48 becomes an opening area that is preset according to the delivery flow rate of the hydraulic pump 14.

The output port of the hydraulic pump 15 is connected to the selector valves 46 and 47, the proportional valve 49, and a relief valve 22 via a flow path 205. The input port of the hydraulic pump 15 is connected to the tank 25.

The relief valve 22 releases the hydraulic working fluid to the tank 25 and protects the circuit when the flow path pressure has become a predetermined pressure or higher.

The selector valves 46 and 47 switch the states of the flow paths between the communicating states and the interrupting states according to signals from the controller 50. When there are no signals from the controller 50, the selector valves 46 and 47 are at the interrupting states.

The selector valve 46 is connected to the cap chamber 1*a* of the boom cylinder 1 via the flow path 210.

The selector valve 47 is connected to the cap chamber 3*a* of the arm cylinder 3 via the flow path 213.

The proportional valve 49 changes its opening area and controls the passing flow rate according to a signal from the controller 50. When there are no signals from the controller 50, the opening area of the proportional valve 49 is kept at the maximum opening area. In addition, when the selector valves 46 and 47 are at the interrupting states, the controller 50 gives a signal to the proportional valve 49 such that the opening area of the proportional valve 49 becomes an opening area that is preset according to the delivery flow rate of the hydraulic pump 15.

The delivery port of the charge pump 11 is connected to a charge relief valve 20 and charge check valves 26, 27, 28*a*, 28*b*, 29*a*, and 29*b* via a charge line 212. The suction port of the charge pump 11 is connected to the tank 25. The charge pump 11 supplies the hydraulic fluid to the charge line 212.

The charge relief valve 20 releases the hydraulic working fluid to the tank 25 when the flow path pressure of the charge line 212 has become a predetermined pressure or higher, and keeps the pressure of the charge line 212 at a constant pressure.

The charge check valve 26 supplies the hydraulic fluid from the charge line 212 to the flow paths 200 and 201 when the pressures of the flow paths 200 and 201 have fallen below a pressure set at the charge relief valve 20.

The charge check valve 27 supplies the hydraulic fluid from the charge line 212 to the flow paths 202 and 203 when the pressures of the flow paths 202 and 203 have fallen below a pressure set at the charge relief valve 20.

The charge check valves 28*a* and 28*b* supply the hydraulic fluid from the charge line 212 to the flow paths 210 and 211 when the pressures of the flow paths 210 and 211 have fallen below a pressure set at the charge relief valve 20.

The charge check valves 29*a* and 29*b* supply the hydraulic fluid from the charge line 212 to the flow paths 213 and 214 when the pressures of the flow paths 213 and 214 have fallen below a pressure set at the charge relief valve 20.

Relief valves 30*a* and 30*b* provided on the flow paths 200 and 201 release the hydraulic working fluid to the charge line 212 and protect the circuits When the flow path pressures have become a predetermined pressure or higher.

Relief valves 31*a* and 31*b* provided on the flow paths 202 and 203 release the hydraulic working fluid to the charge line 212 and protect the circuits when the flow path pressures have become a predetermined pressure or higher.

The boom cylinder 1 is a hydraulic single rod cylinder that is actuated to extend or retract by being supplied with the hydraulic working fluid. The cap chamber 1*a* of the boom cylinder 1 is connected with the flow path 210, and a rod chamber 1*b* of the boom cylinder 1 is connected with the flow path 211. The extension/retraction direction of the boom cylinder 1 depends on the supply direction of the hydraulic working fluid.

Relief valves 32*a* and 32*b* provided on the flow paths 210 and 211 release the hydraulic working fluid to the charge line 212 and protect the circuits when the flow path pressures have become a predetermined pressure or higher.

A flushing valve 34 provided on the flow paths 210 and 211 discharges a surplus oil in the flow paths to the charge line 212.

The arm cylinder 3 is a hydraulic single rod cylinder that is actuated to extend or retract by being supplied with the hydraulic working fluid. The cap chamber 3*a* of the arm cylinder 3 is connected with the flow path 213, and a rod chamber 3*b* of the arm cylinder 3 is connected with the flow path 214. The extension/retraction direction of the arm cylinder 3 depends on the supply direction of the hydraulic working fluid.

Relief valves 33*a* and 33*b* provided on the flow paths 213 and 214 release the hydraulic working fluid to the charge line 212 and protect the circuits when the flow path pressures have become a predetermined pressure or higher.

A flushing valve 35 provided on the flow paths 213 and 214 discharges a surplus oil in the flow paths to the charge line 212.

A stroke sensor 60 installed on the boom cylinder 1 measures the stroke of the boom cylinder 1, and inputs the stroke to the controller 50. The controller 50 computes the posture (angle) of the boom 2 from the stroke of the boom cylinder 1.

A stroke sensor 61 installed on the arm cylinder 3 measures the stroke of the arm cylinder 3, and inputs the stroke to the controller 50. The controller 50 computes the posture (angle) of the arm 4 from the stroke of the arm cylinder 3.

Note that although the stroke sensors 60 and 61 are used as means (a boom angle sensor and an arm angle sensor) that sense the postures (angles) of the boom 2 and the arm 4 in the present embodiment, angle sensors attached to the rotation shafts of the boom 2 and the arm 4 or IMUs attached to the boom 2 and the arm 4 may be used.

The lever 51 is operated by an operator, and inputs the operation amount for each actuator to the controller 50.

A horizontal-pushing/arc-excavation selector switch 52 is means (bucket locus selecting device) for selecting the movement locus of the bucket 6. The horizontal-pushing/arc-excavation selector switch 52 is operated by the operator, and inputs a result of selection of a horizontal pushing mode or an arc excavation mode mentioned later to the controller 50.

Figure 4:
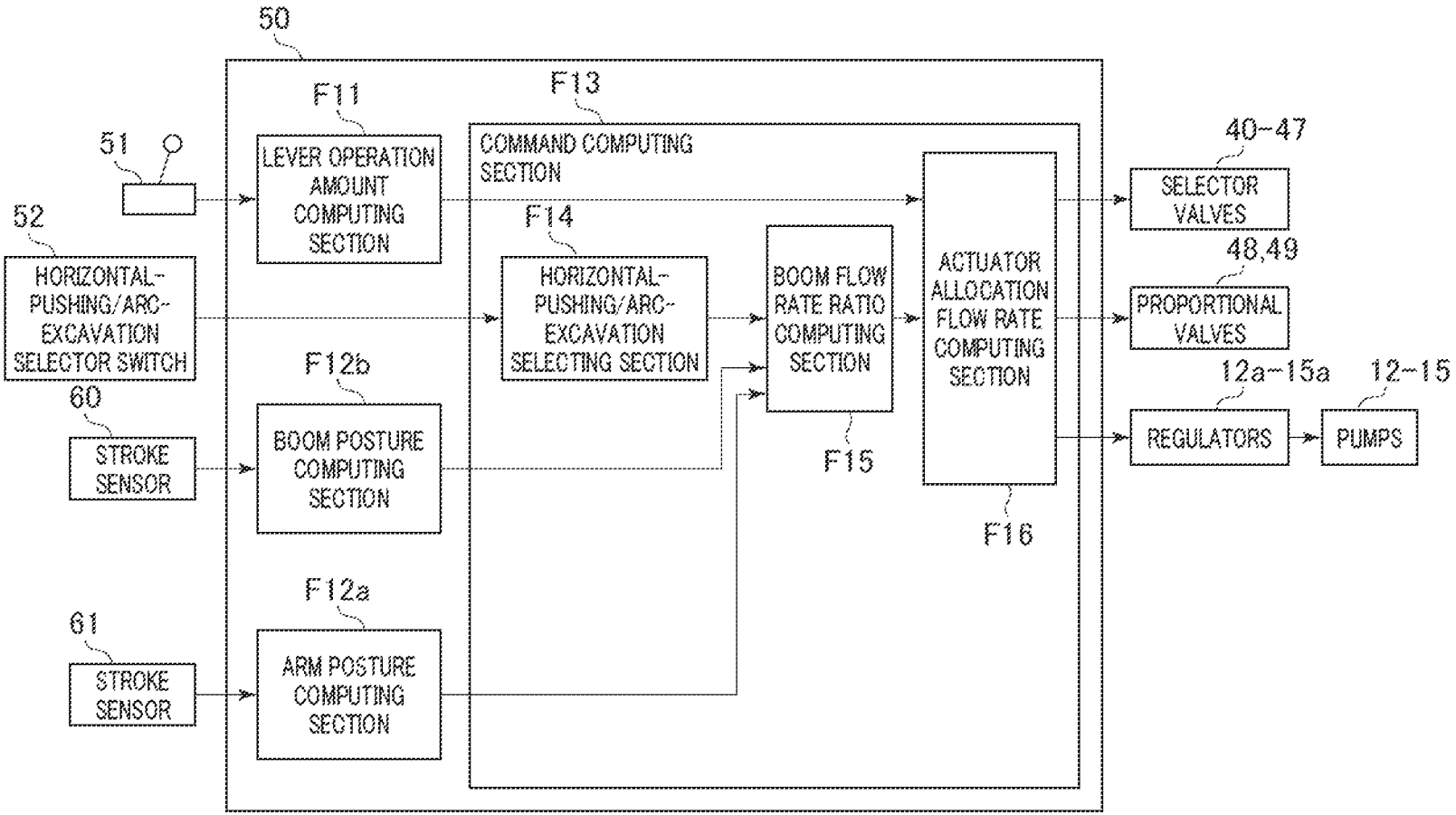
FIG. 4 is a functional block diagram of a controller depicted in FIG. 3.

FIG. 4 is a functional block diagram of the controller 50. Note that similar to FIG. 3, FIG. 4 depicts only portions related to driving of the boom cylinder 1 and the arm cylinder 3, and portions related to driving of other actuators are omitted.

In FIG. 4, the controller 50 has a lever operation amount computing section F11, a boom posture computing section F12*b*, an arm posture computing section F12*a*, and a command computing section F13.

The lever operation amount computing section F11 computes operation directions and target operation speeds of the actuators 1 and 3 according to input from the lever 51, and inputs the operation directions and the target operation speeds to the command computing section F13.

The boom posture computing section F12*b* computes the posture (angle) of the boom 2 from a value (the stroke of the boom cylinder 1) of the stroke sensor 60, and inputs the posture to the command computing section F13.

The arm posture computing section F12*a* computes the posture (angle) of the arm 4 from a value (the stroke of the arm cylinder 3) of the stroke sensor 61, and inputs the posture to the command computing section F13.

The command computing section F13, on the basis of the input from the lever operation amount computing section F11, the boom posture computing section F12*b*, and the arm posture computing section F12*a*, computes and outputs command values to the selector valves 40 to 47, the proportional valves 48, and 49, and the regulators 12*a* to 15*a*.

The command computing section F13 has a horizontal-pushing/arc-excavation selecting section F14, a boom flow rate ratio computing section F15, and an actuator allocation flow rate computing section F16.

The horizontal-pushing/arc-excavation selecting section F14 selects either the horizontal pushing mode or the arc excavation mode on the basis of input from the horizontal-pushing/arc-excavation selector switch 52, and inputs the selected one to the boom flow rate ratio computing section F15.

The boom flow rate ratio computing section F15 computes a flow rate ratio $\alpha$ which is a ratio of a discharge flow rate Qb of a flow from the cap chamber 1*a* of the boom cylinder 1 to a supply flow rate Qa of a flow to the cap chamber 3*a* of the arm cylinder 3 on the basis of the input from the boom posture computing section F12*b* and the arm posture computing section F12*a* when the horizontal pushing mode is inputted from the horizontal-pushing/arc-excavation selecting section F14. The discharge flow rate Qb of the flow from the cap chamber 1*a* of the boom cylinder 1 is represented by the following Formula (1) by using the flow rate ratio $\alpha$.

[Equation 1]

$$Qb=\alpha Qa \tag{1}$$

Here, the flow rate ratio $\alpha$ is decided geometrically on the basis of an initial angle $\theta b0$ of the boom 2 and an initial angle $\theta a0$ of the arm 4. That is, the flow rate ratio $\alpha$ is represented by the following Formula (2).

[Equation 2]

$$\alpha=f(\theta b0,\theta a0) \tag{2}$$

Note that when the length of the arm cylinder 3 at time of the start of excavation is always the most retracted length, the flow rate ratio $\alpha$ is decided on the basis of only the initial angle $\theta b0$ of the boom 2. That is, the supply flow rate ratio $\alpha$ is represented by the following Formula (3).

[Equation 3]

$$\alpha=f(\theta b0) \tag{3}$$

The actuator allocation flow rate computing section F16 computes and outputs command values to the selector valves 40 to 47, the proportional valves 48 and 49, and the regulators 12*a* to 15*a* on the basis of the input from the lever operation amount computing section F11 and the boom flow rate ratio computing section F15.

Next, operation of the hydraulic drive system 300 according to the present embodiment is explained.

(1) At Time of Non-Operation

In FIG. 3, at time of non-operation of the lever 51, the hydraulic pumps 12 to 15 are controlled to be at the minimum tilting angles, all of the selector valves 40 to 47 are closed, and the boom cylinder 1 and the arm cylinder 3 are kept at the stopped states.

(2) At Time of Arm Pushing Operation (at Time of Selection of Horizontal Pushing)

Figure 5:
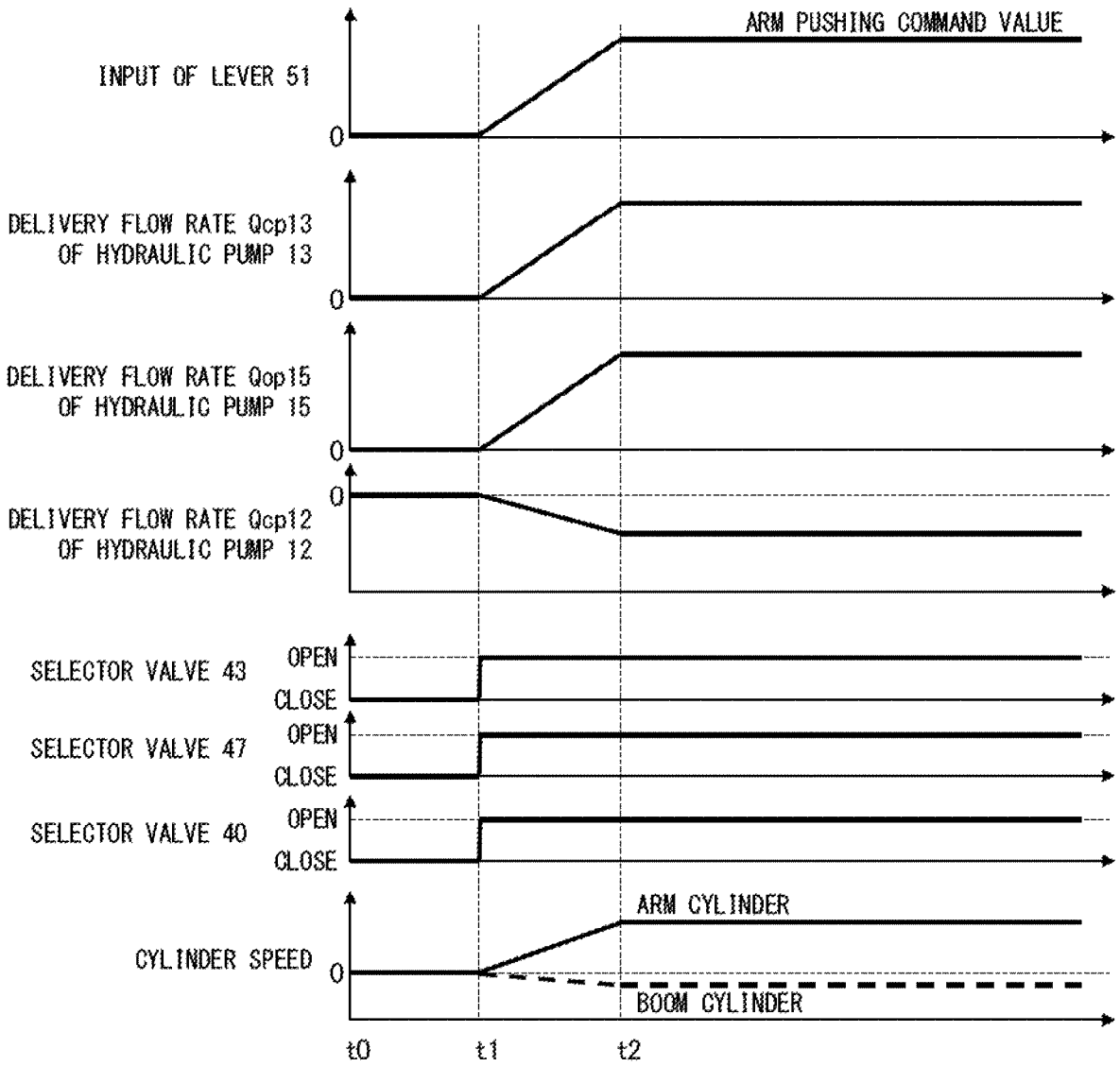
FIG. 5 is a figure depicting changes in the lever input, the delivery flow rates of hydraulic pumps, the opened/closed states of selector valves, and the speeds (cylinder speeds) of an arm cylinder and a boom cylinder when a horizontal pushing mode is selected via a horizontal-pushing/arc-excavation selector switch and an instruction for arm pushing single operation is given via a lever.

FIG. 5 depicts changes in the input of the lever 51, the delivery flow rates Qcp13, Qop15, and Qcp12 of the hydraulic pumps 13, 15, and 12, the opened/closed states of the selector valves 43, 47, and 40 and the speeds (cylinder speeds) of the arm cylinder 3 and the boom cylinder 1 when the horizontal pushing mode is selected via the horizontal-pushing/arc-excavation selector switch 52 and an instruction for arm pushing single operation is given via the lever 51.

From time t0 to time t1, all of command values which are instructions for operation of the actuators based on the input of the lever 51 are 0, and the arm cylinder 3 and the boom cylinder 1 are stationary.

From time t1 to time t2, a command value (hereinafter, referred to as the arm pushing command value) which is an instruction for extending operation (arm pushing operation) of the arm cylinder 3 based on the input of the lever 51 is increased to the maximum value.

Figure 6:
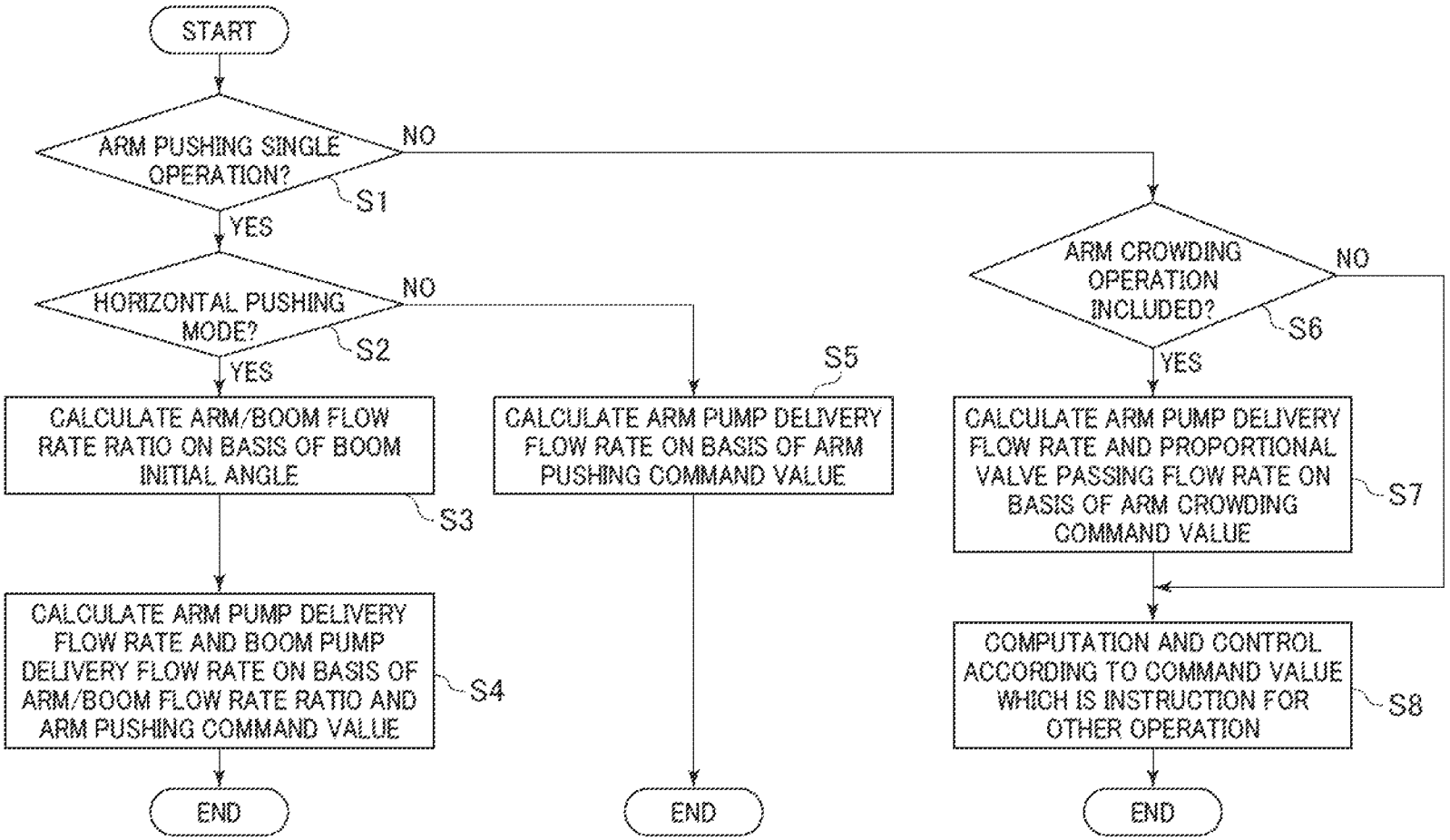
FIG. 6 is a flowchart depicting a process at a command computing section of the controller depicted in FIG. 4.

FIG. 6 is a flowchart depicting a process at the command computing section F13 of the controller 50.

First, at Step S1, the controller 50 determines whether or not the input of the lever 51 is arm pushing single operation. Since this operation is arm pushing single operation, the procedure proceeds to Step S2.

At Step S2, the controller 50 determines whether or not the horizontal pushing mode is selected. Since the horizontal pushing mode is selected in this operation, the procedure proceeds to Step S3.

At Step S3, the controller 50 computes the posture (angle) of the boom 2 on the basis of a signal (the stroke of the boom cylinder 1) of the stroke sensor 60. Further, the ratio (flow rate ratio $\alpha$) of the discharge flow rate of the flow from the cap chamber 1*a* of the boom cylinder 1 to the supply flow rate of the flow to the cap chamber 3*a* of the arm cylinder 3 for performing the horizontal pushing operation is computed, and the procedure proceeds to Step S4.

At Step S4, the controller 50 computes the supply flow rate Qa of the flow to the cap chamber 3*a* of the arm cylinder 3 on the basis of the arm pushing command value. Furthermore, the discharge flow rate Qb of the flow from the cap chamber 1*a* of the boom cylinder 1 is computed from the flow rate ratio $\alpha$ determined at Step S3 and the supply flow rate Qa of the flow to the cap chamber 3*a* of the arm cylinder 3, and the process is completed.

As depicted in FIG. 5, from time t1 to time t2, the regulators 13*a* and 15*a* are controlled such that the hydraulic fluid is supplied from the hydraulic pumps 13 and 15 at the supply flow rate Qa of the flow to the cap chamber 3*a* of the arm cylinder 3 computed at Step S4 depicted in FIG. 6. The selector valve 43 is opened at time t1 in order to connect the hydraulic pump 13 to the arm cylinder 3, and the selector valve 47 is opened at time t1 in order to connect the hydraulic pump 15 to the cap chamber 3*a* of the arm cylinder 3.

In addition, the delivery flow rate of the hydraulic pump 12 is controlled such that the hydraulic fluid is absorbed by the hydraulic pump 12 at the discharge flow rate Qb of the flow from the cap chamber 1*a* of the boom cylinder 1 computed at Step S4 depicted in FIG. 6. The selector valve 40 is opened at time t1 in order to connect the hydraulic pump 12 to the boom cylinder 1.

By controlling the delivery flow rates of the pumps and opening and closing of the selector valves in response to the lever input for arm single pushing operation as described above, the retraction speed of the boom cylinder 1 is controlled properly relative to the extension speed of the arm cylinder 3, and the horizontal pushing operation is realized.

In the present embodiment, only the hydraulic pump 12 is used for retraction of the boom cylinder 1. Since the hydraulic pump 12 is a closed circuit pump, and the pressure of the cap chamber 1*a* becomes higher than the pressure of the rod chamber 1*b* in boom lowering operation, the sucking side pressure of the hydraulic pump 12 becomes higher, and the hydraulic pump 12 behaves as a hydraulic motor and applies regenerative torque to the power transmission device 10. The regenerated torque can be used for driving of the hydraulic pumps 13 and 15, and the fuel consumption amount of the engine 9 can be reduced. In addition, by controlling the boom lowering by using only the pumps, the control precision for the flow rates can be enhanced as compared to control performed by using valves in which the flow rates vary undesirably due to the influence of pressures, and thus it is possible to enhance the trackability of a target locus in horizontal pushing.

When only the hydraulic pump 12 is used for retraction of the boom cylinder 1 as in the present embodiment, the hydraulic fluid is discharged to the charge line 212 via the flushing valve 34 at a surplus flow rate that is generated from the ratio between the cap side and rod side pressure receiving areas of the cylinder. If the discharge flow rate increases, the pressure of the charge line 212 increases undesirably. In order to prevent this, at time t1, the selector valve 44 may be opened, and a part of the flow may be discharged from the proportional valve 48 to the tank 25.

(3) At Time of Arm Pushing Operation (at Time of Arc Excavation Selection)

Figure 7:
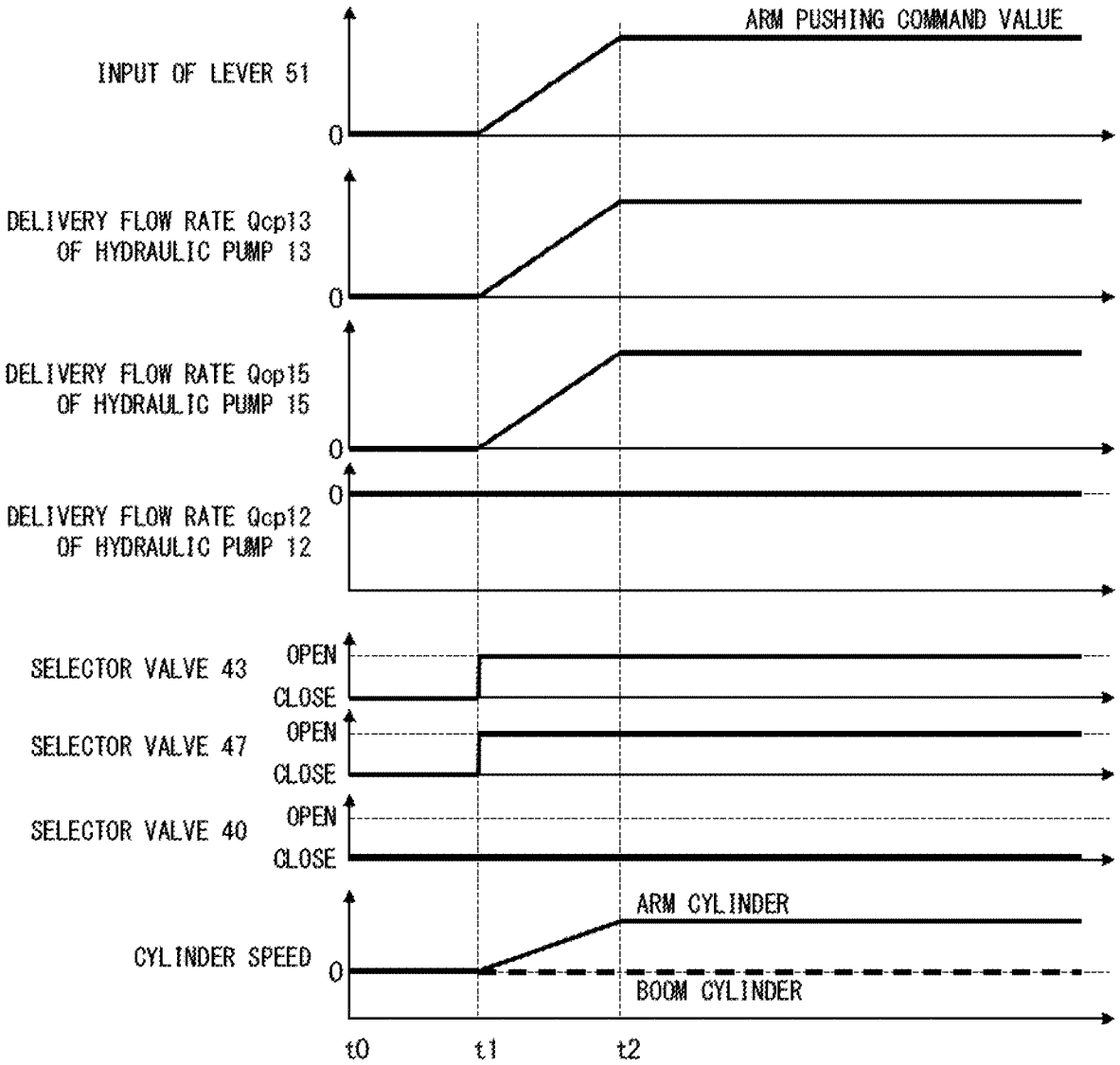
FIG. 7 is a figure depicting changes in the lever input, the delivery flow rates of the hydraulic pumps, the opened/closed states of the selector valves, and the speeds (cylinder speeds) of the arm cylinder and the boom cylinder when an arc excavation mode is selected via the horizontal-pushing/arc-excavation selector switch and an instruction for arm pushing single operation is given via the lever.

FIG. 7 depicts changes in the input of the lever 51, the delivery flow rates Qcp13, Qop15, and Qcp12 of the hydraulic pumps 13, 15, and 12, the opened/closed states of the selector valves 43, 47, and 40, and the speeds (cylinder speeds) of the arm cylinder 3 and the boom cylinder 1 when the arc excavation mode is selected via the horizontal-pushing/arc-excavation selector switch 52 and an instruction for arm pushing single operation is given via the lever 51.

From time t0 to time t1, all of command values which are instructions for operation of the actuators based on the input of the lever 51 are 0, and the arm cylinder 3 and the boom cylinder 1 are stationary.

From time t1 to time t2, the arm pushing command value based on the input of the lever 51 is increased to the maximum value.

At Step S1 depicted in FIG. 6, the controller 50 first determines whether or not the input of the lever 51 is arm single operation. Since this operation is arm pushing single operation, the procedure proceeds to Step S2.

At Step S2, the controller 50 determines whether or not the horizontal pushing mode is selected. Since the arc excavation mode is selected in this operation, the procedure proceeds to Step S5.

At Step S5, the controller 50 computes the supply flow rate Qa of the flow to the cap chamber 3*a* of the arm cylinder 3 on the basis of the lever input for the arm pushing single operation, and completes the process.

As depicted in FIG. 5, from time t1 to time t2, the regulators 13*a* and 15*a* are controlled such that the hydraulic fluid is supplied from the hydraulic pumps 13 and 15 at the supply flow rate Qa of the flow to the cap chamber 3*a* of the arm cylinder 3 computed at Step S4 depicted in FIG. 6. The selector valve 43 is opened at time t1 in order to connect the hydraulic pump 13 to the arm cylinder 3, and the selector valve 47 is opened at time t1 in order to connect the hydraulic pump 15 to the cap chamber 3*a* of the arm cylinder 3.

On the other hand, since the boom cylinder 1 is not driven, the delivery flow rate of the hydraulic pump 12 is kept at 0, and the selector valve 40 also is kept at the closed state.

By controlling the delivery flow rates of the pumps and opening and closing of the selector valves in response to the lever input for the arm pushing single operation as described above, only the arm cylinder 3 is driven, and thus the bucket 6 is moved along an arc locus about a point at which the boom 2 and the arm 4 are connected to each other.

(3) At Time of Arm Crowding Operation

Figure 8:
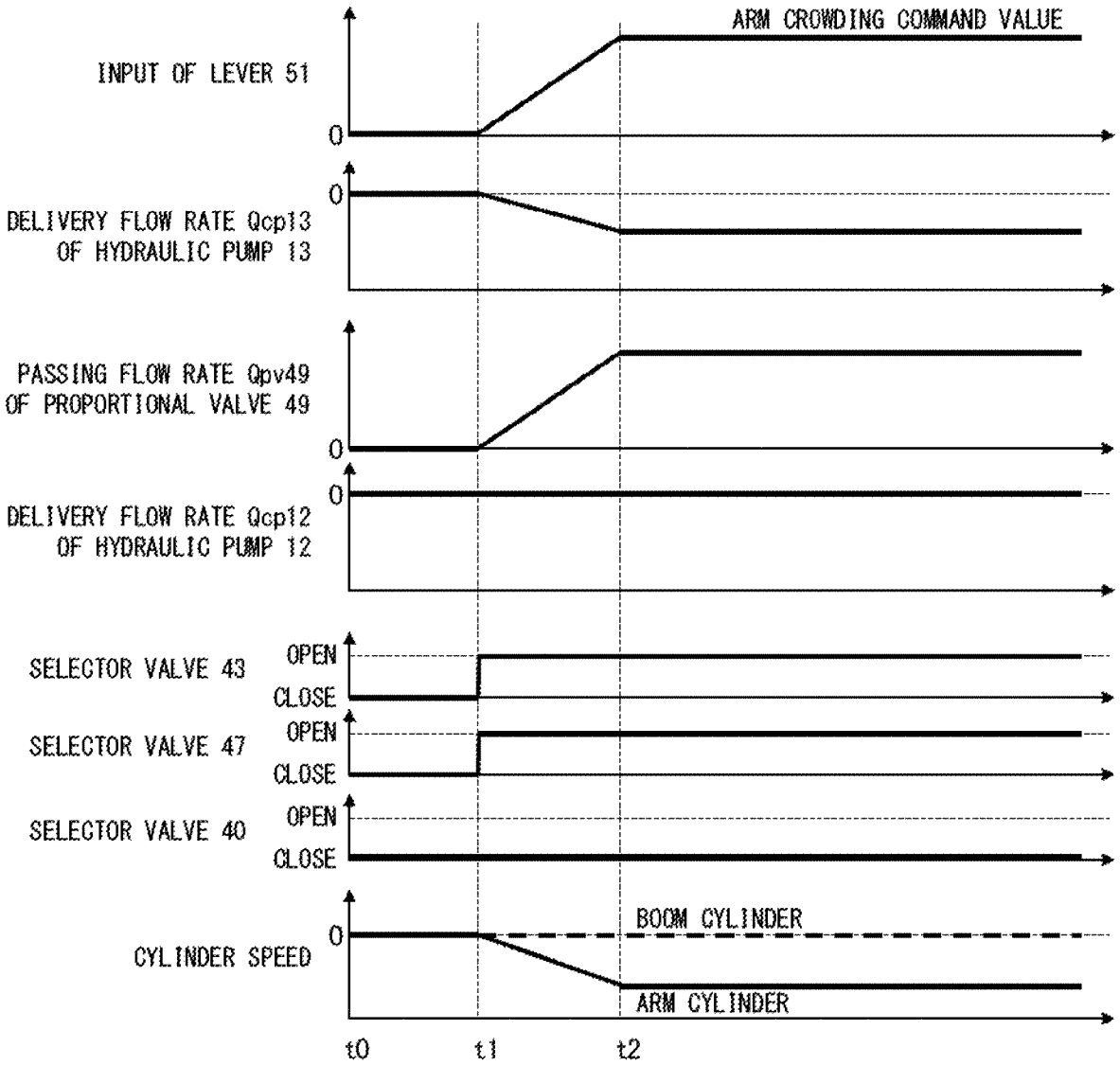
FIG. 8 is a figure depicting changes in the lever input, the delivery flow rates of the hydraulic pumps, the passing flow rate of a proportional valve, the opened/closed states of the selector valves, and the arm cylinder (cylinder speed) when an instruction for arm crowding single operation is given via the lever independently of the switching state of the horizontal-pushing/arc-excavation selector switch.

FIG. 8 depicts changes in the input of the lever 51, the delivery flow rates Qcp13 and Qcp12 of the hydraulic pumps 13 and 12, the passing flow rate Qpv49 of the proportional valve 49, the opened/closed states of the selector valves 43, 47, and 40, and the speed (cylinder speed) of the arm cylinder 3 when an instruction for arm crowding operation is given via the lever 51.

From time t0 to time t1, all of command values which are instructions for operation of the actuators based on the input of the lever 51 are 0, and the arm cylinder 3 and the boom cylinder 1 are stationary.

From time t1 to time t2, a command value (hereinafter, referred to as the arm crowding command value) which is an instruction for retracting operation (arm crowding operation) of the arm cylinder 3 based on the lever 51 is increased to the maximum value.

At Step S1 depicted in FIG. 6, the controller 50 first determines whether or not the input of the lever 51 is arm pushing single operation. Since this lever input includes arm crowding operation, the procedure proceeds to Step S6.

At Step S6, the controller 50 determines whether or not the lever input includes arm crowding operation. Since this operation is arm crowding single operation, the procedure proceeds to Step S7.

At Step S7, the controller 50 computes the supply flow rate of the flow to the rod chamber 3*b* of the arm cylinder 3 on the basis of the arm crowding command value.

As depicted in FIG. 8, from time t1 to time t2, the regulator 13*a* is controlled such that the hydraulic fluid is supplied from the hydraulic pump 13 at the computed supply flow rate of the flow to the rod chamber 3*b* of the arm cylinder 3. In addition, the passing flow rate Qpv49 of the proportional valve 49 is controlled such that the difference between the discharge flow rate of the flow from the cap chamber 3*a* of the arm cylinder 3 and the supply flow rate of the flow to the rod chamber 3*b* is compensated for. The selector valve 43 is opened at time t1 in order to connect the hydraulic pump 13 to the arm cylinder 3, and the selector valve 47 is opened at time t1 in order to connect the proportional valve 49 to the cap chamber 3*a* of the arm cylinder 3.

On the other hand, since the boom cylinder 1 is not driven, the delivery flow rate Qcp12 of the hydraulic pump 12 is kept at 0, and the selector valve 40 also is kept at the closed state.

Returning to FIG. 6, when the lever input includes an operation instruction for operation other than arm crowding operation, at Step S8, computation and control according to a command value which is an instruction for such other operation are performed.

By controlling the delivery flow rates of the pumps and opening and closing of the selector valves in response to the lever input for arm single crowding operation as described above, the arm cylinder 3 singly realizes the crowding operation.

In the present embodiment, in the construction machine 100 including: the boom 2; the arm 4 pivotably attached to the boom 2; the bucket 6 pivotably attached to the arm 4; the boom cylinder 1 that drives the boom 2 in the raising direction by extending operation, and drives the boom 2 in the lowering direction by retracting operation; the arm cylinder 3 that drives the arm 4 in the pushing direction by extending operation, and drives the arm 4 in the crowding direction by retracting operation; the operation device 51 that gives instructions for operation of the boom 2 and the arm 4; the bidirectionally tiltable first hydraulic pump 12 that can be connected to the boom cylinder 1 to form a closed circuit; the bidirectionally tiltable second hydraulic pumps 13 and 15 that can be connected to the arm cylinder 3 to form closed circuits; and the controller 50 that, according to operation of the operation device 51, controls the flow rate of the hydraulic fluid supplied from the first hydraulic pump 12 to the boom cylinder 1, and the flow rate of the hydraulic fluid supplied from the second hydraulic pumps 13 and 15 to the arm cylinder 3, the construction machine 100 includes: the boom angle sensor 60 that senses the angle of the boom 2; and the bucket locus selecting device 52 that selects either one of an arc locus and a straight locus as the movement locus of the bucket 6 at time of pushing operation of the arm 4, the controller 50: when the straight locus is selected via the bucket locus selecting device 52, calculates the constant flow rate ratio $\alpha$ according to the boom initial angle $\theta b0$ which is the angle of the boom 2 sensed by the boom angle sensor 60 at a time point when an instruction for pushing operation of the arm 4 is started being given via the operation device 51, and controls the delivery flow rate of the first hydraulic pump 12 such that the hydraulic fluid is discharged from the cap chamber 1*a* of the boom cylinder 1 at the flow rate Qb obtained by multiplying the flow rate Qa of the flow supplied to the cap chamber 3*a* of the arm cylinder 3 by the flow rate ratio $\alpha$ while the instruction for the pushing operation of the arm 4 is given via the operation device 51 and an instruction for operation of the boom 2 is not given; and controls the delivery flow rate of the second hydraulic pump 13 such that the hydraulic fluid is absorbed from the cap chamber 3*a* of the arm cylinder 3 by the second hydraulic pump 13 at a flow rate according to the input of the operation device 51 independently of the selection state of the bucket locus selecting device 52 while the instruction for crowding operation of the arm 4 is given via the operation device 51.

According to the thus configured present invention, when a straight locus is selected via the bucket locus selecting device 52 and an instruction for pushing operation of the arm 4 is given via the operation device 51, the constant flow rate ratio $\alpha$ is calculated on the basis of the boom initial angle $\theta b0$, and while an instruction for pushing operation of the arm 4 is given via the operation device 51 and an instruction for operation of the boom 2 is not given, the delivery flow rate of the first hydraulic pump 12 is controlled such that the hydraulic fluid is discharged from the cap chamber 1*a* of the boom cylinder 1 at a flow rate obtained by multiplying the flow rate of the flow supplied to the cap chamber 3*a* of the arm cylinder 3 by the flow rate ratio $\alpha$. Thereby, it becomes possible for an operator to linearly push the bucket 6 simply by giving an instruction for pushing operation of the arm 4 via the operation device.

In addition, the construction machine 100 according to the present embodiment further includes the arm angle sensor 61 that senses the angle of the arm 4, and the controller 50 calculates the flow rate ratio $\alpha$ on the basis of the boom initial angle $\theta b0$ and the arm initial angle $\theta a0$ which is the angle of the arm 4 sensed at the arm angle sensor 61 at a time point when the instruction for pushing operation of the arm 4 is started being given via the operation device 51. Thereby, it becomes possible to adjust the height of the bucket 6 when the bucket 6 is moved along a straight locus.

In addition, the hydraulic excavator 100 includes the plurality of hydraulic actuators 1, 3, and 5 including the boom cylinder 1 and the arm cylinder 3, the plurality of hydraulic pumps 12 to 15 including the first hydraulic pump 12 and the second hydraulic pumps 13 and 15, and the plurality of selector valves 40 to 47 that can switch the states of connection between the plurality of hydraulic actuators 1, 3, and 5 and the plurality of hydraulic pumps 12 to 15. Thereby, it becomes possible for the operator to linearly push the bucket 6 of the construction machine 100 on which the hydraulic closed circuit system is mounted simply by operating the arm 4 in the pushing direction.

Second Embodiment

The hydraulic excavator 100 according to a second embodiment of the present invention is explained with a focus on differences from the first embodiment. Although the pushing direction of the bucket 6 is limited to the horizontal direction in the first embodiment, the present embodiment is configured such that the angle of the pushing direction can be changed.

Figure 9:
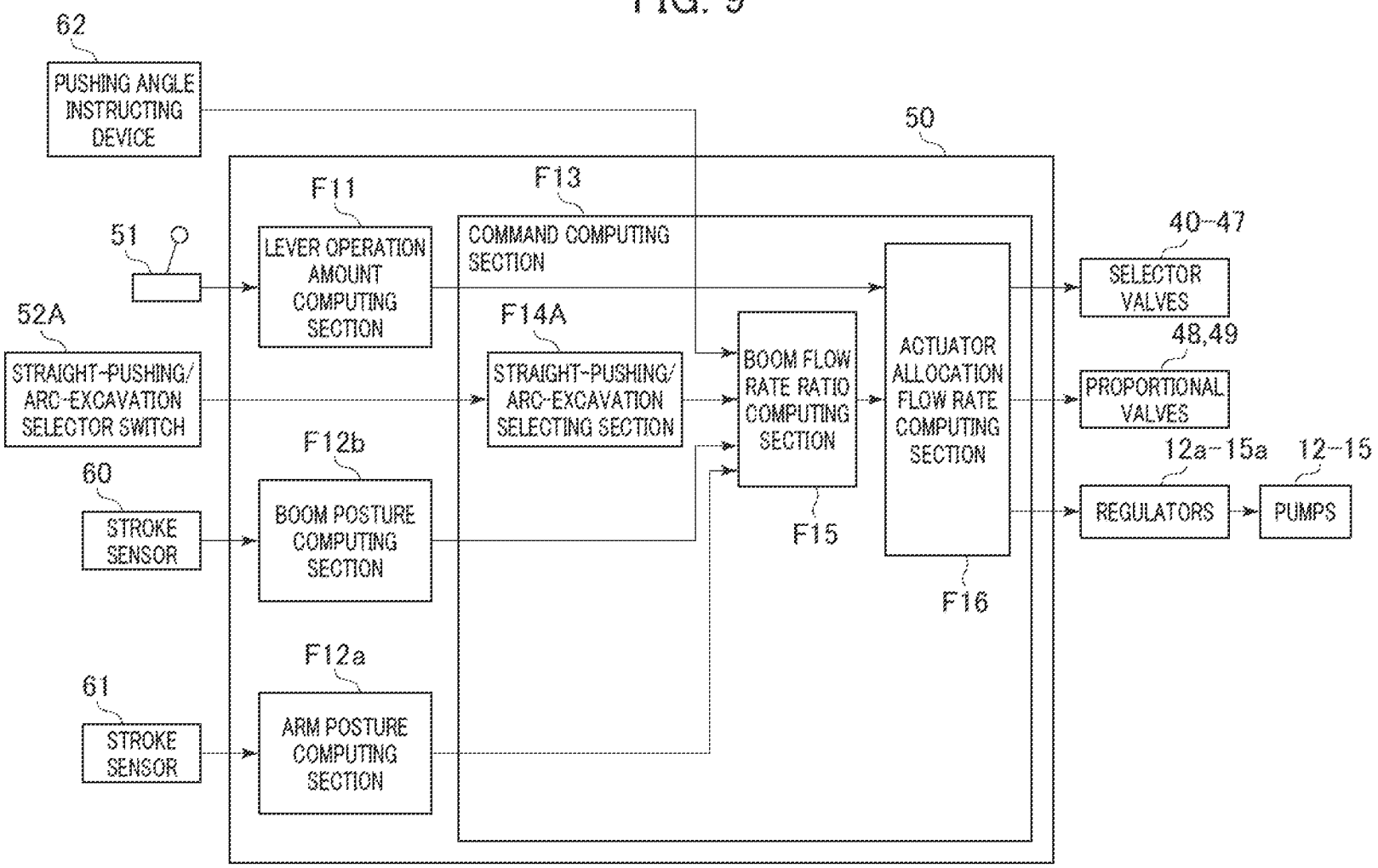
FIG. 9 is a functional block diagram of the controller in a second embodiment of the present invention.

FIG. 9 is a functional block diagram of the controller 50 in the present embodiment. In FIG. 9, differences from the first embodiment (depicted in FIG. 4) are that a pushing angle instructing device 62 that gives an instruction for a demanded pushing angle of the bucket 6 is provided in the cab 104 (depicted in FIG. 1), and, instead of the horizontal-pushing/arc-excavation selector switch 52 and the horizontal-pushing/arc-excavation selecting section F14, a straight-pushing/arc-excavation selector switch 52A and a straight-pushing/arc-excavation selecting section F14A are included. A signal from the pushing angle instructing device 62 is inputted to the boom flow rate ratio computing section F15 of the controller 50.

When the straight pushing mode is inputted from the straight-pushing/arc-excavation selecting section F14A, the boom flow rate ratio computing section F15 in the present embodiment computes the flow rate ratio α on the basis of input from the boom posture computing section F12*b*, the arm posture computing section F12*a*, and the pushing angle instructing device 62. Here, the supply flow rate ratio α is decided on the basis of the initial angle θb0 of the boom 2, the initial angle θa0 of the arm 4, and the demanded pushing angle θd. That is, the supply flow rate ratio α is represented by the following Formula (4).

[Equation 4]

$$\alpha = f(\theta b0, \theta a0, \theta d) \quad (4)$$

Figure 10:
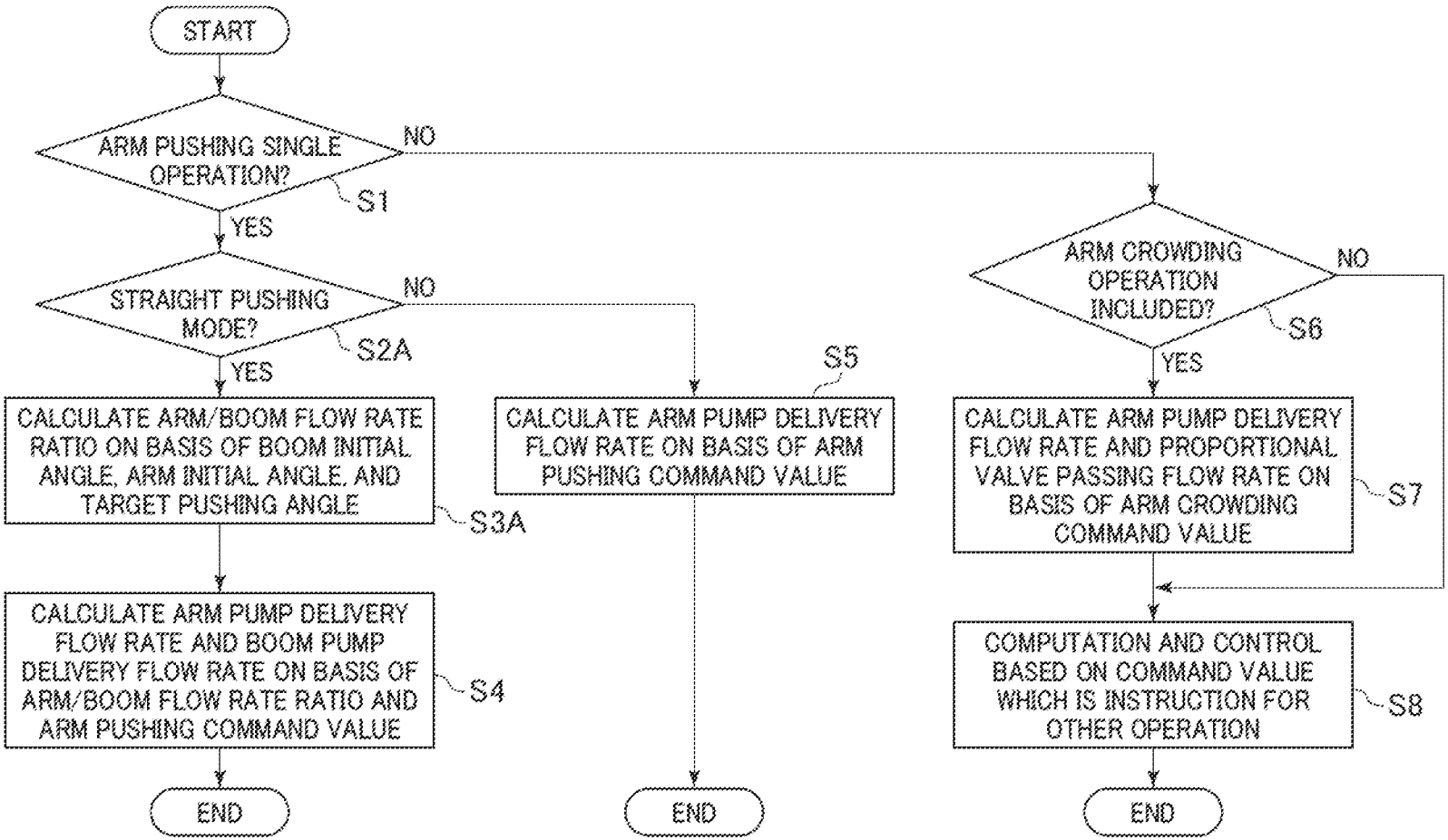
FIG. 10 is a flowchart depicting a process at the command computing section of the controller in the second embodiment of the present invention.

FIG. 10 is a flowchart depicting a process at the command computing section F13 of the controller 50 according to the present embodiment. In FIG. 10, a difference from the first embodiment (depicted in FIG. 6) is that Steps S2A and S3A are included instead of Steps S2 and S3.

At Step S2A, the controller 50 determines whether or not the straight pushing mode is selected.

At Step S3A, the controller 50 computes the posture (angle) of the boom 2 on the basis of a signal (the stroke of the boom cylinder 1) of the stroke sensor 60. Further, the ratio (flow rate ratio α) of the discharge flow rate of the flow from the cap chamber 1*a* of the boom cylinder 1 to the supply flow rate of the flow to the cap chamber 3*a* of the arm cylinder 3 for performing straight pushing operation is computed, and the procedure proceeds to Step S4.

The construction machine 100 according to the present embodiment further includes the pushing angle instructing device 62 that gives an instruction for the ground angle which is an angle of the straight locus of the bucket 6 relative to the ground, and the controller 50 decides the flow rate ratio α on the basis of the boom initial angle θb0, the arm initial angle θa0, and the ground angle.

The construction machine 100 according to the thus configured present embodiment makes it possible for an operator to linearly push the bucket 6 at a desired angle simply by operating the arm 4 in the pushing direction.

Third Embodiment

The hydraulic excavator 100 according to a third embodiment of the present invention is explained with a focus on differences from the first embodiment and the second embodiment. Although mainly pushing operation of the bucket 6 is mentioned in the first embodiment and the second embodiment, advantages at time of crowding operation are mentioned in the present embodiment.

Figure 11:
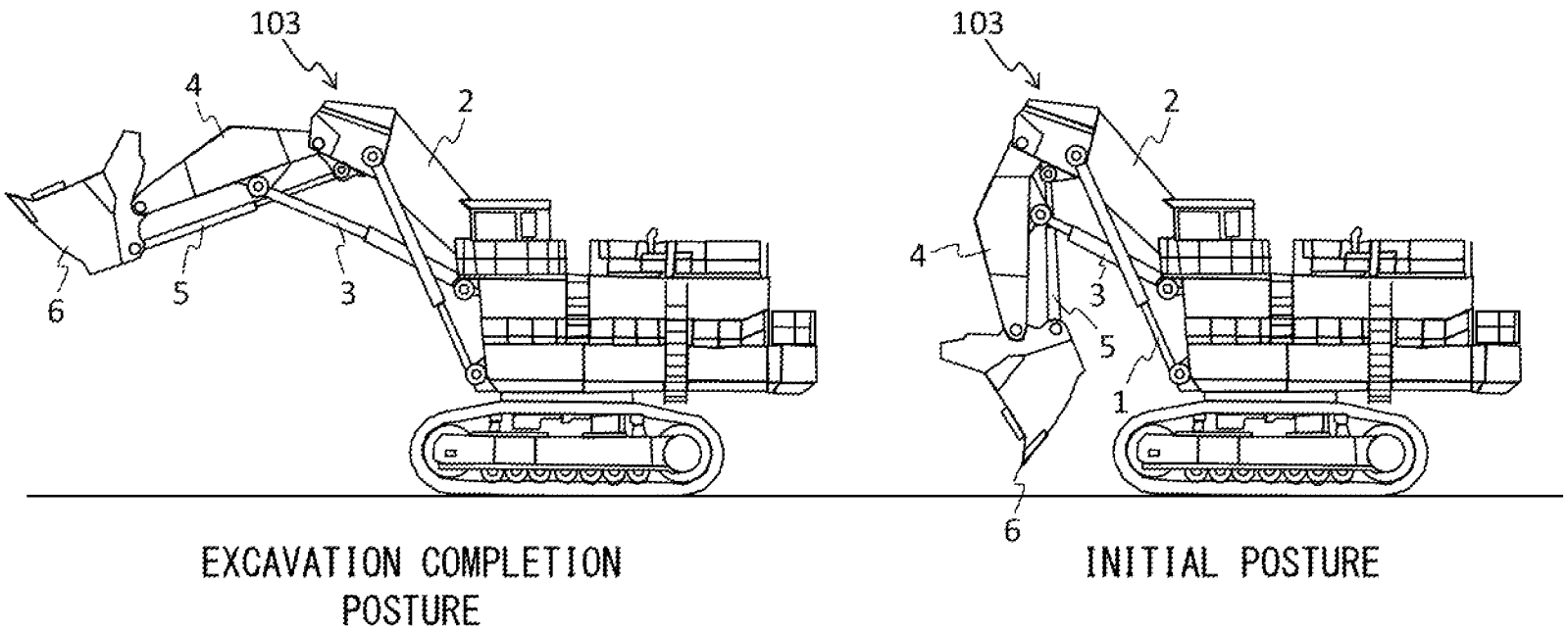
FIG. 11 is a figure depicting operation of returning to the initial posture of the hydraulic excavator depicted in FIG. 1 from the load completion posture.

As depicted in FIG. 11, the hydraulic excavator 100 after excavation and loading performs operation of returning to a posture (initial posture) at which the arm 4 is crowded from a posture (load completion posture) at which the arm 4 is pushed and the boom 2 is raised.

Figure 12:
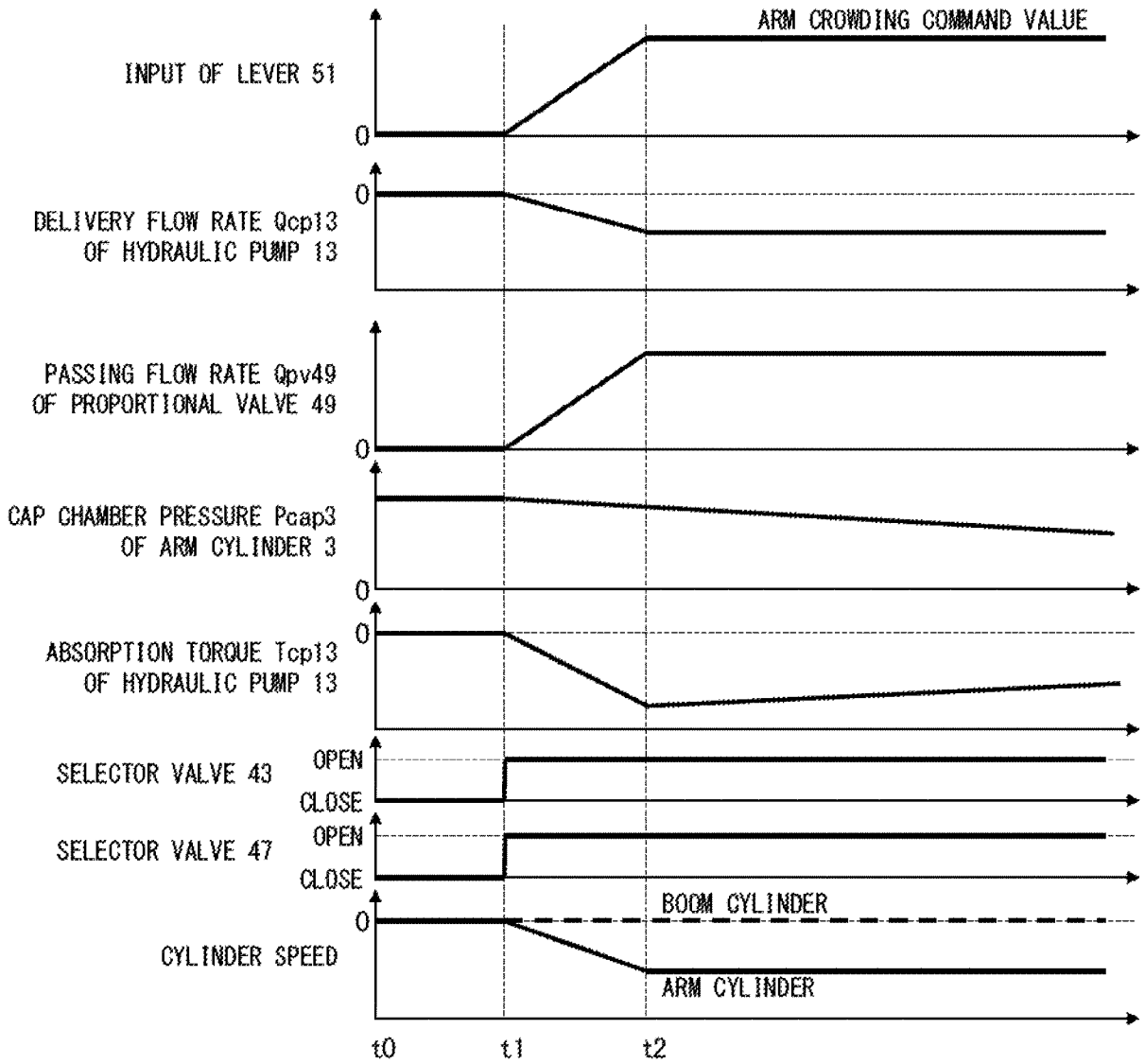
FIG. 12 is a figure depicting changes in the lever input, the delivery flow rate of the hydraulic pump, the passing flow rate of the proportional valve, the cap chamber pressure of the arm cylinder, the absorption torque of the hydraulic pump, the opened/closed states of the selector valves, and the speed (cylinder speed) of the arm cylinder when an instruction for arm crowding single operation is given via the lever at the loading posture depicted in FIG. 11.

FIG. 12 depicts changes in the input of the lever 51, the delivery flow rate Qcp13 of the hydraulic pump 13, the passing flow rate Qpv49 of the proportional valve 49, the cap chamber pressure Pcap3 of the arm cylinder 3, the absorption torque Tcp13 of the hydraulic pump 13, the opened/closed states of the selector valves 43 and 47, and the speed (cylinder speed) of the arm cylinder 3 when an instruction for arm crowding single operation is given via the lever 51 at the load completion posture depicted in FIG. 11.

From time t0 to time t1, all of command values which are instructions for operation of the actuators based on the input of the lever 51 are 0, and the arm cylinder 3 and the boom cylinder 1 are stationary.

From time t1 to time t2, the arm crowding command value based on the input of the lever 51 is increased to the maximum value.

The controller 50 computes the supply flow rate of the flow to the rod chamber 3*b* of the arm cylinder 3 on the basis of the arm crowding command value.

As depicted in FIG. 12, from time t1 to time t2, the regulator 13*a* is controlled such that the hydraulic fluid is supplied from the hydraulic pump 13 at the computed supply flow rate of the flow to the rod chamber 3*b* of the arm cylinder 3. In addition, the passing flow rate of the proportional valve 49 is controlled such that the difference between the discharge flow rate of the flow from the cap chamber 3*a* of the arm cylinder 3 and the supply flow rate of the flow to the rod chamber 3*b* is compensated for. The selector valve 43 is opened at time t1 in order to connect the hydraulic pump 13 to the arm cylinder 3, and the selector valve 47 is opened at time t1 in order to connect the proportional valve 49 to the cap chamber 3*a* of the arm cylinder 3.

As depicted in FIG. 12, as the hydraulic excavator 100 returns to the initial posture from the load completion posture depicted in FIG. 11, the pressure Pcap3 of the cap chamber 3*a* of the arm cylinder 3 lowers. When the hydraulic excavator 100 is at the load completion posture depicted in FIG. 11, the pressure Pcap3 of the cap chamber 3*a* of the arm cylinder 3 becomes higher than the pressure of the rod chamber 3*b*. Accordingly, the pressure of the suction side (flow path 202) of the hydraulic pump 13 becomes higher than the pressure of the delivery side (flow path 203). When the suction side pressure is higher, the hydraulic pump 13 acts as a hydraulic motor, and thus the absorption torque Tcp13 of the hydraulic pump 13 becomes a negative value. As depicted in FIG. 12, as the delivery flow rate Qcp13 of the hydraulic pump 13 increases from time t1 to time t2, the absorption torque Tcp13 of the hydraulic pump 13 increases toward the negative side. After time t2, the delivery flow rate Qcp13 of the hydraulic pump 13 becomes a constant flow rate, but the pressure Pcap3 of the cap chamber 3*a* of the arm cylinder 3 decreases due to a postural change in the arm 4; as a result, the absorption torque Tcp13 of the hydraulic pump 13 decreases.

By controlling the delivery flow rates of the pumps and opening and closing of the selector valves in response to the lever input for arm crowding operation as described above, the arm cylinder 3 realizes the crowding operation. Since the hydraulic pump 13 is a closed circuit pump, and the pressure Pcap3 of the cap chamber 3*a* becomes higher than the pressure of the rod chamber 3*b* in arm crowding operation, the sucking side pressure of the hydraulic pump 13 becomes higher, and the hydraulic pump 13 behaves as a hydraulic motor and applies regenerative torque to the power transmission device 10. Due to the regenerated torque, the fuel consumption amount of the engine 9 can be reduced.

Note that although it is attempted to accelerate the cylinder speed by discharging, to the tank 25 via the proportional valve 49, a part of the hydraulic working fluid discharged from the cap chamber 3*a* at time of arm crowding operation in the present embodiment, the total volume of the hydraulic working fluid discharged from the cap chamber 3*a* may be absorbed by the hydraulic pump 13 while the proportional valve 49 is kept closed. Thereby, it becomes possible also to increase the regenerative torque of the hydraulic pump 13, and to use the regenerative torque for driving another actuator.

Although embodiments of the present invention are described in detail thus far, the present invention is not limited to the embodiments described above, and includes various modification examples. For example, the embodiments described above are explained in detail for explaining the present invention in an easy to understand manner, and are not necessarily limited to those including all the configurations explained. In addition, it is also possible to add some of the configurations of an embodiment to the configurations of another embodiment, and it is also possible to remove some of the configurations of an embodiment or to replace some of the configurations of an embodiment with some of the configurations of another embodiment.

DESCRIPTION OF REFERENCE CHARACTERS

1: Boom cylinder (hydraulic actuator)
1*a*: Cap chamber
1*b*: Rod chamber
2: Boom
3: Arm cylinder (hydraulic actuator)
3*a*: Cap chamber
3*b*: Rod chamber
4: Arm
5: Bucket cylinder (hydraulic actuator)
6: Bucket
7: Swing device
8: Travel device
9: Engine
10: Power transmission device
11: Charge pump
12: Hydraulic pump (first hydraulic pump)
12*a*: Regulator
13: Hydraulic pump (second hydraulic pump)
13*a*: Regulator
14: Hydraulic pump
14*a*: Regulator
15: Hydraulic pump (second hydraulic pump)
15*a*: Regulator
20: Charge relief valve
21, 22: Relief valve
25: Tank
26, 27: Charge check valve
28*a*, 28*b*: Charge check valve
29*a*, 29*b*: Charge check valve
30*a*, 30*b*: Relief valve
31*a*, 31*b*: Relief valve
32*a*, 32*b*: Relief valve
33*a*, 33*b*: Relief valve
34, 35: Flushing valve
40 to 47: Selector valve
48, 49: Proportional valve
50: Controller
51: Lever (operation device)
52: Horizontal-pushing/arc-excavation selector switch (bucket locus selecting device)
52A: Straight-pushing/arc-excavation selector switch (bucket locus selecting device)
60: Stroke sensor (boom angle sensor)
61: Stroke sensor (arm angle sensor)
62: Pushing angle instructing device
100: Hydraulic excavator (construction machine)
101: Lower travel structure
102: Upper swing structure
103: Front work implement
104: Cab
200 to 211, 213: Flow path
212: Charge line
300: Hydraulic drive system

The invention claimed is:

1. A construction machine comprising:
a boom;
an arm pivotably attached to the boom;
a bucket pivotably attached to the arm;
a boom cylinder that drives the boom in a raising direction by extending operation, and drives the boom in a lowering direction by retracting operation;
an arm cylinder that drives the arm in a pushing direction by extending operation, and drives the arm in a crowding direction by retracting operation;
an operation device that operates the boom and the arm;
a bidirectionally tiltable first hydraulic pump that can be connected to the boom cylinder to form a closed circuit;
a bidirectionally tiltable second hydraulic pump that can be connected to the arm cylinder to form a closed circuit; and
a controller that, according to operation of the operation device, controls a flow rate of a hydraulic fluid supplied from the first hydraulic pump to the boom cylinder and a flow rate of the hydraulic fluid supplied from the second hydraulic pump to the arm cylinder, wherein
the construction machine includes
a boom angle sensor that senses an angle of the boom, and
a bucket locus selecting device that selects either one of an arc locus and a straight locus as a movement locus of the bucket, the movement locus being according to operation of the arm in the pushing direction, and
the controller is configured to,
in a case where the straight locus is selected by the bucket locus selecting device, calculate a constant flow rate ratio according to a boom initial angle that is the angle of the boom sensed by the boom angle sensor at a time point when the arm is operated in the pushing direction by the operation device, and control a delivery flow rate of the first hydraulic pump such that the hydraulic fluid is discharged from a cap chamber of the boom cylinder at a flow rate obtained by multiplying a rate of a flow supplied to a cap chamber of the arm cylinder by the flow rate ratio while the arm is operated in the pushing direction by the operation device and there is not an instruction for operation of the boom, and control a delivery flow rate of the second hydraulic pump such that the hydraulic fluid is absorbed from the cap chamber of the arm cylinder by the second hydraulic pump at a flow rate according to input of the operation device independently of a selection state of the bucket locus selecting device while the arm is operated in the crowding direction by the operation device.

2. The construction machine according to claim 1, further comprising:

an arm angle sensor that senses an angle of the arm, wherein the controller is configured to calculate the flow rate ratio on a basis of the boom initial angle and an arm initial angle that is the angle of the arm sensed at the arm angle sensor at a time point when the arm is operated in the pushing direction by the operation device.

3. The construction machine according to claim 2, further comprising:

a pushing angle instructing device that gives an instruction for a ground angle that is an angle of the straight locus relative to a ground, wherein the controller is configured to decide the flow rate ratio on a basis of the boom initial angle, the arm initial angle, and the ground angle.

4. The construction machine according to claim 1, comprising:

a plurality of hydraulic actuators including the boom cylinder and the arm cylinder;

a plurality of hydraulic pumps including the first hydraulic pump and the second hydraulic pump; and a plurality of selector valves that can switch states of connection between the plurality of hydraulic actuators and the plurality of hydraulic pumps.

* * * * *